US008943722B2

(12) United States Patent
Barrett

(10) Patent No.: US 8,943,722 B2
(45) Date of Patent: Feb. 3, 2015

(54) EMERGENCY GUIDANCE AND ALERTING SYSTEM AND METHOD

(71) Applicant: Ronald J Barrett, Buffalo, NY (US)

(72) Inventor: Ronald J Barrett, Buffalo, NY (US)

( * ) Notice: Subject to any disclaimer, the term of this patent is extended or adjusted under 35 U.S.C. 154(b) by 53 days.

(21) Appl. No.: 13/896,563

(22) Filed: May 17, 2013

(65) Prior Publication Data

US 2014/0338238 A1 Nov. 20, 2014

Related U.S. Application Data

(60) Provisional application No. 61/654,432, filed on Jun. 1, 2012.

(51) Int. Cl.
*G09F 7/00* (2006.01)
*G09F 7/18* (2006.01)

(52) U.S. Cl.
CPC .. *G09F 7/18* (2013.01); *G09F 7/00* (2013.01); *G09F 2007/1852* (2013.01)
USPC ..... 40/597; 40/606.07; 116/200

(58) Field of Classification Search
CPC ..... G09F 2019/225; G09F 2007/122
USPC ..... 40/597, 606.07, 661; 116/200
See application file for complete search history.

(56) References Cited

U.S. PATENT DOCUMENTS

| | | | | |
|---|---|---|---|---|
| 6,349,491 | B1 * | 2/2002 | Able | 40/124.01 |
| 7,196,614 | B2 | 3/2007 | Carolan | |
| 7,528,700 | B2 | 5/2009 | Picard et al. | |
| 7,746,247 | B2 | 6/2010 | Kimbrough, Jr. et al. | |
| 2004/0040194 | A1 * | 3/2004 | Arraut | 40/654.01 |
| 2007/0006795 | A1 * | 1/2007 | Muchin et al. | 116/200 |
| 2007/0186842 | A1 * | 8/2007 | Pharo et al. | 116/200 |
| 2008/0115396 | A1 * | 5/2008 | Gamboa | 40/661 |
| 2008/0178507 | A1 * | 7/2008 | Dean-McLeod | 40/661 |
| 2011/0283627 | A1 * | 11/2011 | Shaw | 49/478.1 |

* cited by examiner

*Primary Examiner* — Gary Hoge
(74) *Attorney, Agent, or Firm* — Kloss, Stenger & LoTempio; Vincent LoTempio; David Stephenson

(57) ABSTRACT

An emergency guidance and alerting system comprising an organizer located in a room having a door, wherein the organizer is capable of holding a slip sign and a window placard. The slip sign is capable of being placed under a door so that the slip sign can be viewed outside of the room, alerting rescue personnel that an occupant is in the room. The window placard is capable of being attached to a window alerting rescue personnel outside of the room that the occupant is in the room.

9 Claims, 7 Drawing Sheets

EMERGENCY GUIDANCE AND ALERTING SYSTEM AND METHOD

CROSS REFERENCE TO RELATED APPLICATION

This application claims the benefit of U.S. Provisional Application of Ronald Barrett, application No. 61,654,432, filed 1 Jun. 2012, having the title for EMERGENCY GUIDANCE DEVICE AND METHOD OF ALERTING FIRE PERSONNEL, which is incorporated herein by reference in its entirety.

FIELD OF THE INVENTION

This invention relates to emergency guidance and alerting system. More particularly, the invention relates to a system for alerting rescue personnel to potential victims of a fire and a method for using the emergency guidance system for residential homes, schools, hotels, dormitories, apartment/multi-unit complexes, assisting living facilities, senior living complexes, office buildings and the like, to efficiently direct rescue personnel to potential victims in a timely manner and to prevent duplicative searches during rescue operations.

BACKGROUND

Fires and other residential emergencies claim many lives every year. In many cases, rescue personnel are left to making educated guesses as to which rooms have been searched and cleared, and which ones may still have people trapped inside.

Thus, a heretofore unaddressed need exists in the industry to address the aforementioned deficiencies and inadequacies.

SUMMARY

The present disclosure provides systems and methods for alerting rescue personnel to potential victims of a fire.

Briefly described, in architecture, one embodiment of the system comprises an organizer capable of holding a slip sign and a window placard; wherein the slip sign is capable of being placed under a door alerting rescue personnel that an occupant is in a room; and wherein the window placard is capable of being attached to a window alerting rescue personnel that the occupant is in the room.

The present disclosure also provides methods for using an emergency guidance system for residential homes, schools, hotels, dormitories, apartment/multi-unit complexes, assisting living facilities, senior living complexes, office buildings and the like, to efficiently direct rescue personnel to potential victims in a timely manner and to prevent duplicative searches during rescue operations.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

The present invention and the manner in which it may be practiced is further illustrated with reference to the accompanying drawings wherein.

DETAILED DESCRIPTION OF THE EMBODIMENTS

Figure 1:
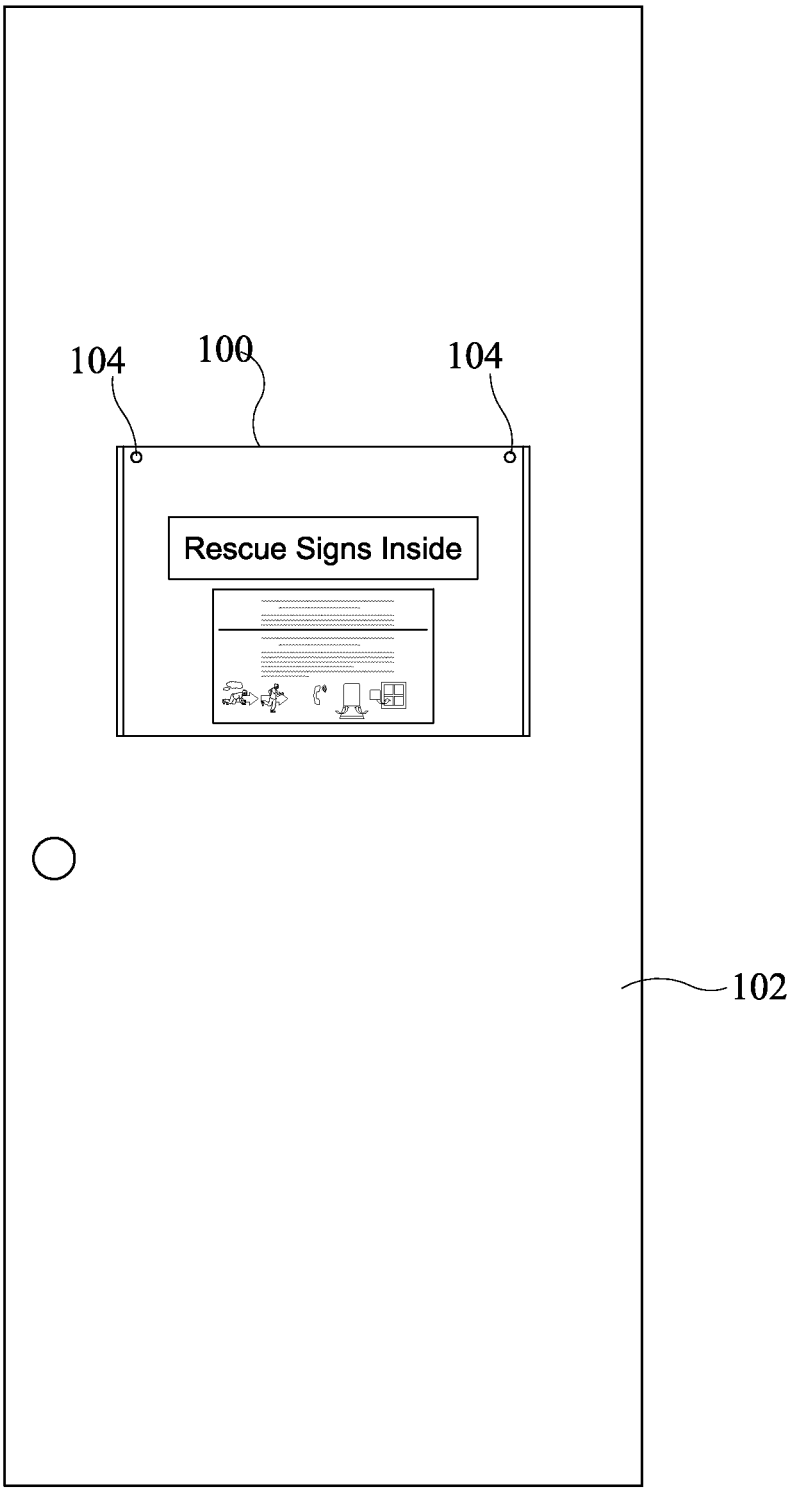
FIG. 1 illustrates an organizer hanging on a door.

Reference is now made in detail to the description of the embodiments as illustrated in the drawings. While several embodiments are described in the connection with these drawings, there is no intent to limit the disclosure to the embodiment or embodiments disclosed herein. On the contrary, the intent is to cover all alternatives, modifications, and equivalents.

It should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Currently it is known in the art that when a building is on fire and an occupant cannot safely evacuate that it becomes necessary for rescue personnel to rescue each occupant as soon as possible. Currently, it is difficult to locate trapped occupants when a building has many rooms such as residential homes, schools, hotels, dormitories, apartment/multi-unit complexes, assisting living facilities, senior living complexes, office buildings and the like. However, an emergency guidance and alerting system of the present disclosure enables rescue personnel to readily identify the occupied rooms and unoccupied rooms. In one embodiment the emergency guidance and alerting system comprises an organizer located in a room having a door, wherein the organizer is capable of holding a slip sign and a window placard. The slip sign is capable of being placed under a door so that the slip sign can be viewed outside of the room, alerting rescue personnel that an occupant is in the room. The window placard is capable of being attached to a window alerting rescue personnel outside of the room that the occupant is in the room. Armed with the knowledge as to which rooms are occupied, rescue personnel are more likely to prevent occupants from becoming victims of a fire.

Figure 7:
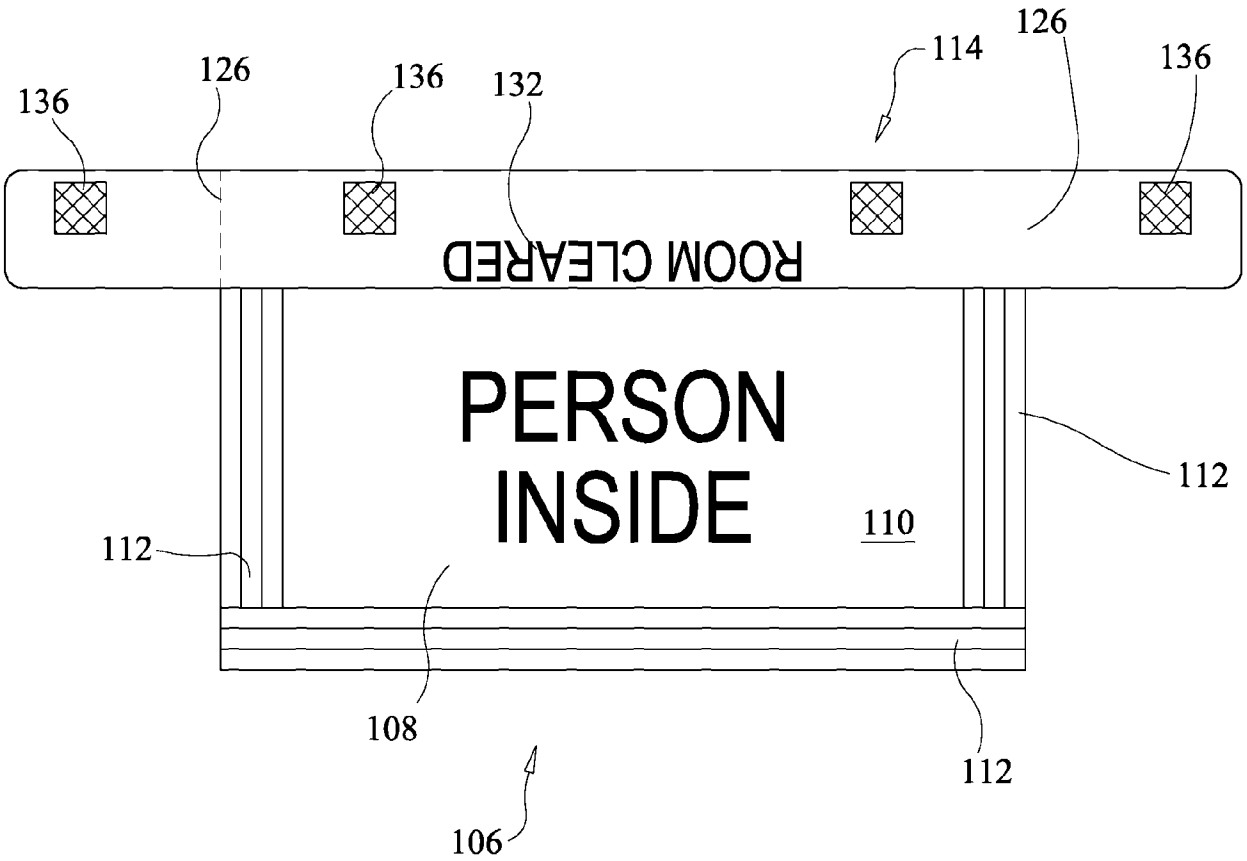
FIG. 7 illustrates a cross-sectional view of a smoke blocker attached to the slip sign.

Adverting now to the drawings, with reference to FIG. 1, a preferred embodiment of the present disclosure is depicted with organizer 100 hanging on door 102. Organizer 100 is an easily accessible storage unit for a slip sign and a window placard. Organizer 100 stores emergency guidance materials providing easy and instant access in an emergency situation. It should be appreciated that organizer 100 can be affixed to any surface that is easily accessible during an emergency. Organizer 100 is affixed to the desired surface by either inserting screws through grommets 104 located at the top of organizer 100, or by using a hook and loop fastener strip 136 (as shown in FIG. 7) such as VELCRO® located on the back of organizer 100 (not shown). Organizer 100 is washable and water resistant.

Figure 2:
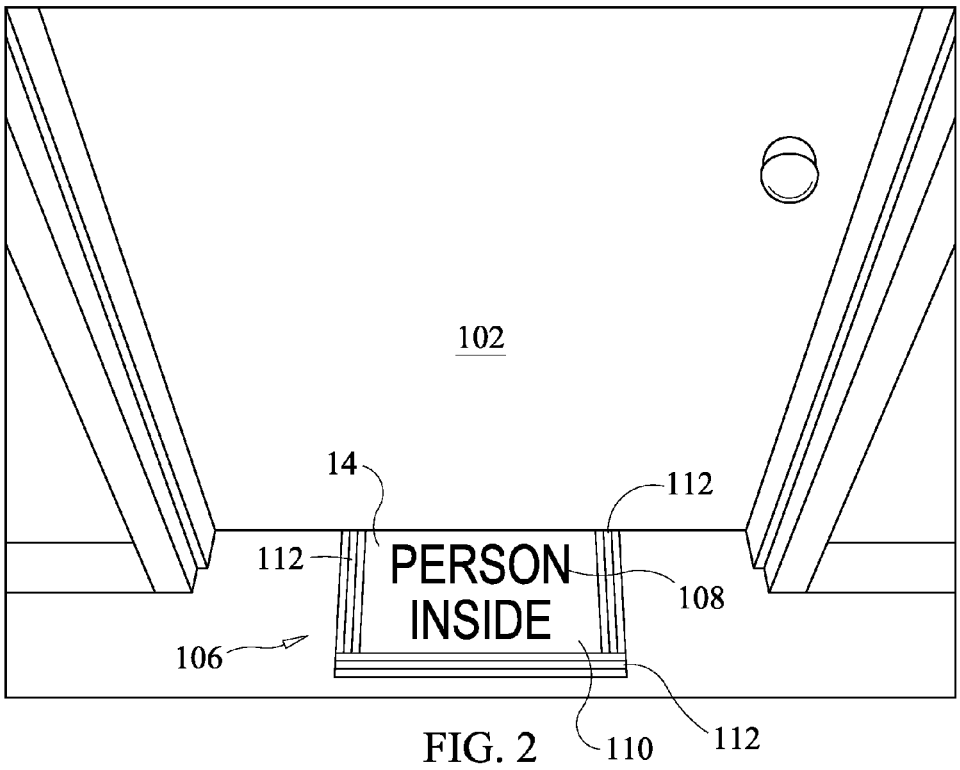
FIG. 2 illustrates a front perspective view from the outside of an occupied room.

FIG. 2 illustrates a front perspective view from the outside of an occupied room. Slip sign 106 is used to alert rescue personnel. Slip sign 106 is positioned under door 102 so the rescue personnel will be alerted that the room is occupied. Slip sign 106 is preferably constructed with lettering 108 to easily alert rescue personnel someone is trapped inside. Lettering 108 may also be reflective, to easily alert rescue personnel someone is trapped inside. Backing 110 of slip sign 106 is a bright, highly visible color, such as yellow or orange. For demonstration purposes only, lettering 108 can use such text as 'PERSON INSIDE', however such phrases as "HELP," "RESCUE ME" and the like could be used. Lettering 108 is affixed to both sides of slip sign 106 to prevent user error. Slip sign 106 is preferably constructed of striping 112, which is highly reflective and is ANSI/ISEA certified for brightness and high visibility. From the outside of the occupied room, slip sign 106 is highly visible to rescue personnel, allowing the rescue personnel to easily identify a room where an occupant is trapped inside.

Figure 3:
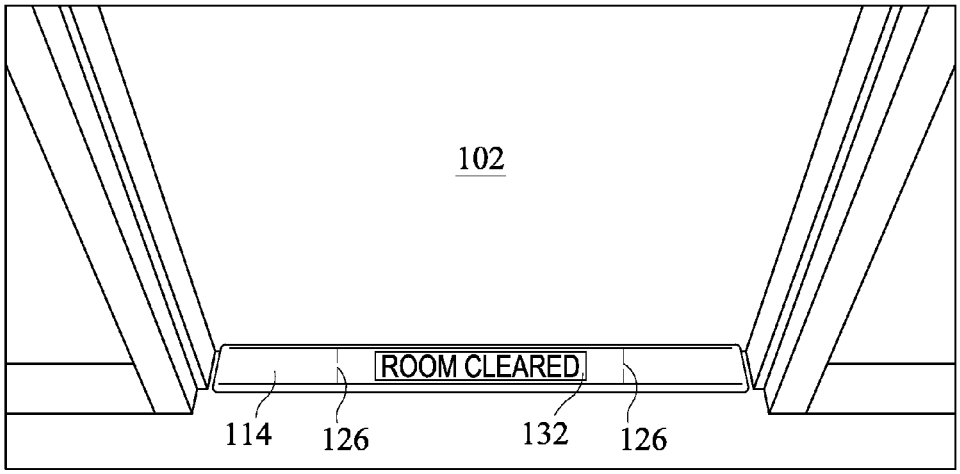
FIG. 3 illustrates a perspective view of a smoke blocker.
Figure 6:
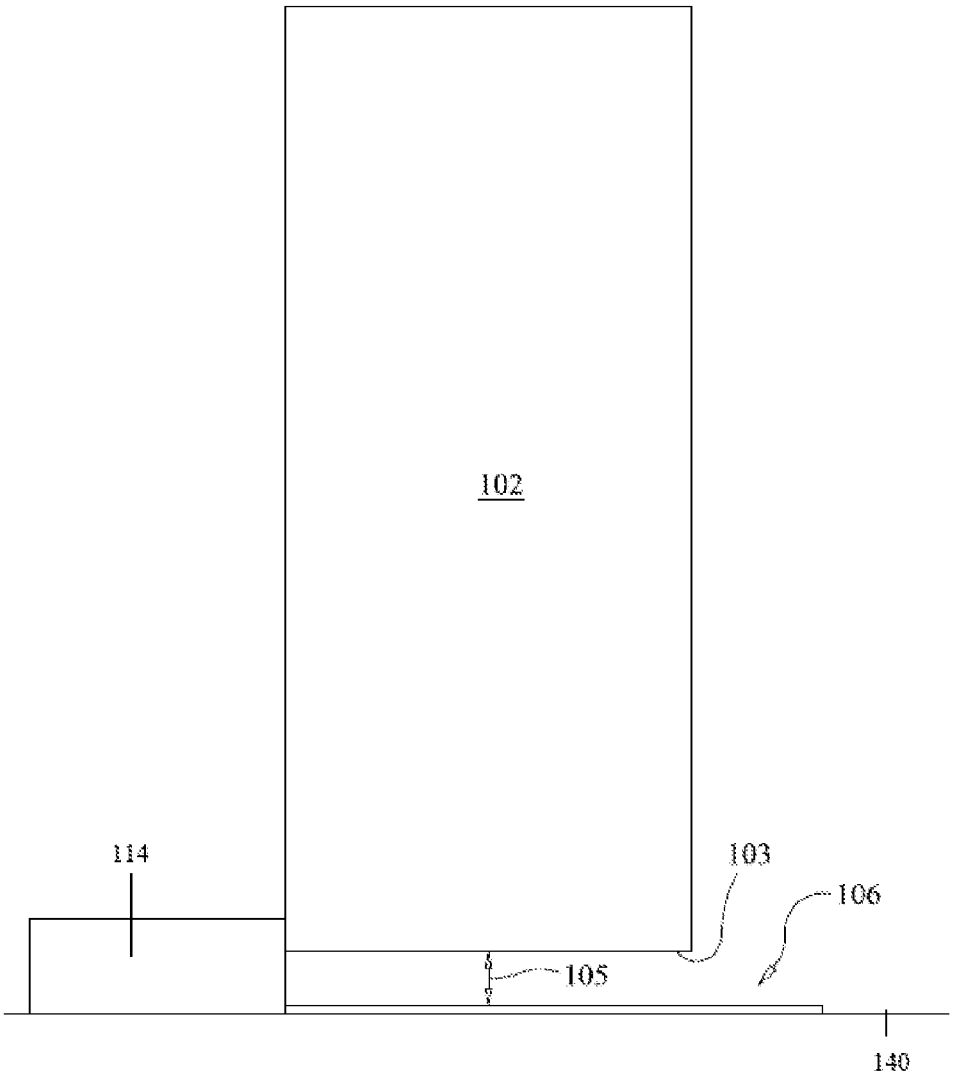
FIG. 6 illustrates a cross-sectional view of a smoke blocker attached to the slip sign, placed under a door.

FIG. 3 illustrates a perspective view of a smoke blocker. The slip sign is configured with smoke blocker 114. When in use, the slip sign is pushed far enough under door 102, so smoke blocker 114, is flush with door 102 on the inside of the room. Smoke blocker 114 blocks smoke by sealing a gap 105 (as shown in FIG. 6) between a bottom surface 103 (as shown in FIG. 6) of door 102 and an underlying floor surface 140 (as shown in FIG. 6). Smoke blocker 114 allows the slip sign to remain in place outside the room during an emergency and prevents the slip sign from pushing away from door 102. This allows the occupant to take shelter in a safe part of the room away from door 102 and a burning hallway. Smoke blocker 114 is capable of being folded inward along dashed line 126, wherein the folded sections of smoke blocker 114 connect to smoke blocker 114 by using hook and loop fastener strip 136 such as VELCRO® attached to smoke blocker 114. For demonstration purposes only, text 132 can use such text as 'ROOM CLEARED', however such phrases as "ROOM EMPTY," "SEARCH COMPLETED," "ROOMED SEARCHED" and the like could be used.

Figure 4:
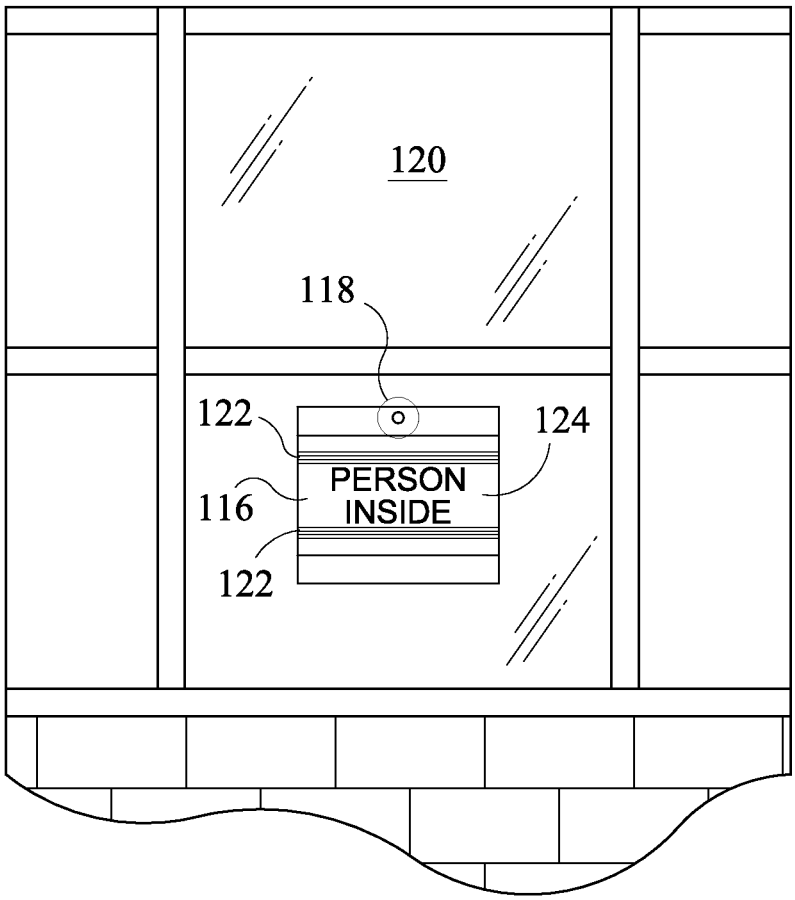
FIG. 4 illustrates a perspective view of a window placard.

FIG. 4 illustrates a perspective view of a window placard. Window placard 116 has a suction cup 118 affixed to a window 120. Window placard 116 is preferably affixed to window 120 using suction cup 118, but it may be affixed by other conventional means such as setting on window sill or window ledge. Suction cup 118 may be double sided, thus helping to prevent user error. Window placard 116 is reflective, featuring two bands 122 that are ANSI/ISEA certified for brightness and allow for high visibility from the outside of the building. Bands 122 are also reflective. Window placard 116 is an additional means of alerting rescue personnel outside the building that someone is trapped inside the room. The occupant could potentially be rescued through window 120 where window placard 116 is affixed, thus eliminating the need for rescue personnel to navigate through the burning building. Window placard 116 is preferably constructed with print 124 to easily alert rescue personnel outside, that someone is trapped inside. Print 124 may also be reflective, to easily alert rescue personnel someone is trapped inside. For demonstration purposes only, print 124 can use such text as 'PERSON INSIDE', however such phrases as "HELP," "RESCUE ME" and the like could be used. Print 124 is affixed to both sides of window placard 116 to prevent user error.

Figure 5:
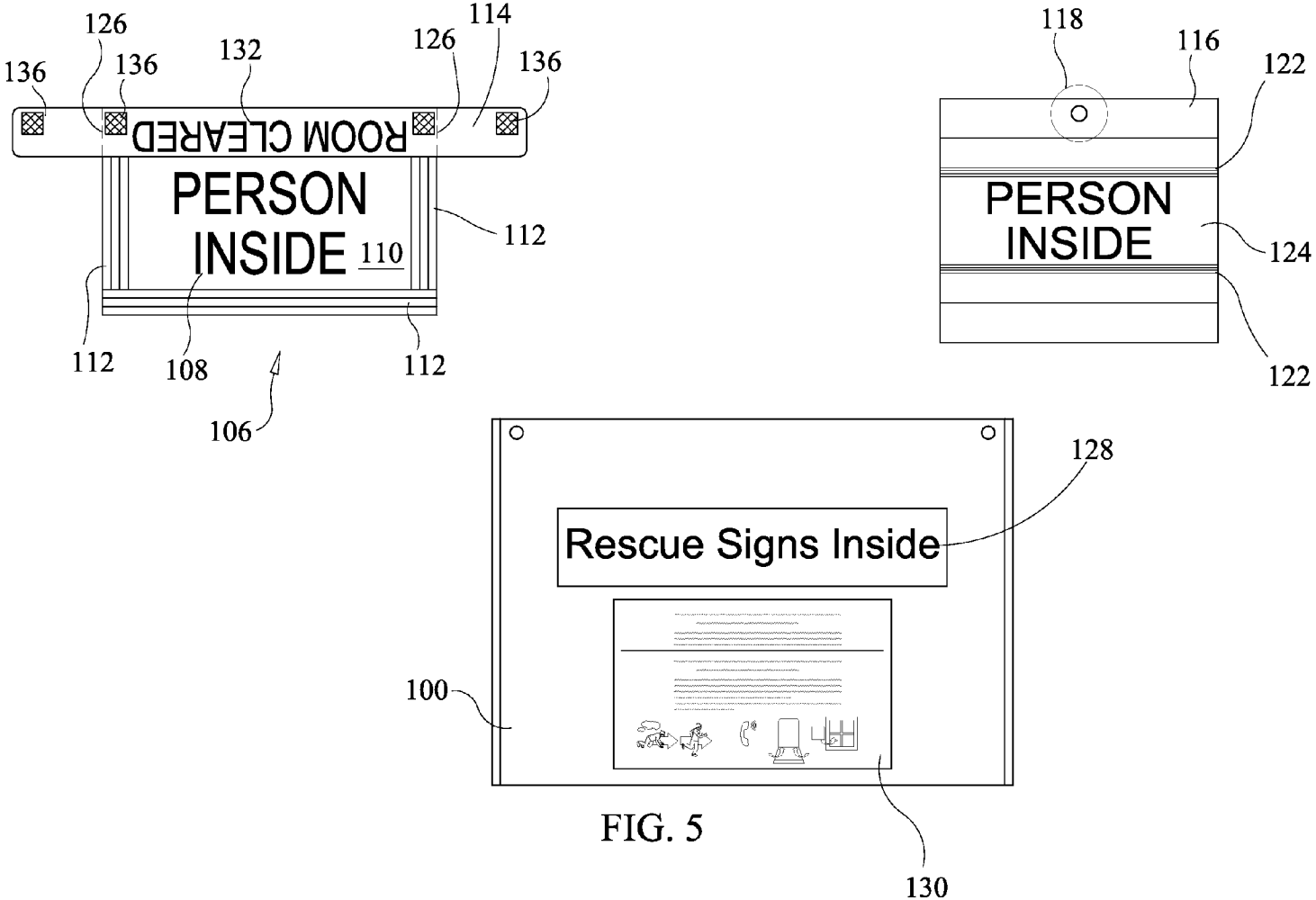
FIG. 5 illustrates a perspective view of a slip sign, an organizer and a window placard.

FIG. 5 illustrates a perspective view of the slip sign, the organizer and the window placard. Slip sign 106 is preferably constructed with lettering 108, wherein backing 110 of slip sign 106 is a bright and a highly visible color, such as yellow or orange. For demonstration purposes only, lettering 108 can use such text as 'PERSON INSIDE.' Slip sign 106 has stripes 112, which is highly reflective and is ANSI/ISEA certified for brightness and high visibility. Attached to slip sign 106 is smoke blocker 114. Smoke blocker 114 blocks smoke by sealing the gap between the bottom surface of the door and the underlying floor surface. Smoke blocker 114 is capable of being folded inward along dashed line 126, wherein the folded sections connect to smoke blocker 114 by using hook and loop fastener strip 136 such as VELCRO® attached to smoke blocker 114. For demonstration purposes only, text 132 can use such text as 'ROOM CLEARED.'

Organizer 100 is an easily accessible storage unit for slip sign 106 and window placard 116 to be stored in. Organizer 100 stores emergency guidance materials providing easy and instant access in an emergency situation. Attached to organizer 100 is a notice 128, which for demonstration purposes only can have the phrase 'RESCUE SIGNS INSIDE.' Also attached to organizer 100 is a direction sheet 130, which provides instructions on how to use the emergency guidance and alerting system. Direction sheet 130 can be either a set of directions shown by writing or drawings or a combination of writings and drawings.

Window placard 116 is capable of being affixed to the window using suction cup 118. Window placard 116 is reflective, featuring two bands 122 that are ANSI/ISEA certified for brightness and allow for high visibility from the outside of the building. Bands 122 are also reflective. For demonstration purposes only, print 124 can use such text as 'PERSON INSIDE.'

Both slip sign 106 and window placard 116 are readily movable allowing rescue personnel to remove slip sign 106 or window placard 116 once the room has been cleared. Once the room has been cleared, slip sign 106 and window placard 116 are removed to prevent duplicative searches, which ultimately saves lives. When the rescue personnel has cleared the room, the rescue personnel upon exiting can turn slip sign 106 around, wherein the smoke blocker is placed outside the room with text 132 'ROOM CLEARED' being shown. Text 132 can be placed on both sides of smoke blocker 114 to prevent user error.

FIGS. 6 and 7 illustrate a cross-sectional view of the smoke blocker attached to the slip sign. Smoke blocker 114 is configured to become flush with door 102, ensuring complete coverage along the entire bottom portion of door 102. Smoke blocker 114 may be constructed of a material with a flexible or elastic property or it may be constructed of a fire resistant shell with fire resistant foam inserted in smoke blocker 114. Slip sign 106 is preferably constructed with lettering 108, wherein backing 110 of slip sign 106 is a bright, highly visible color, such as yellow or orange. For demonstration purposes only, lettering 108 can use such text as 'PERSON INSIDE.' Slip sign 106 has striping 112, which is highly reflective and is ANSI/ISEA certified for brightness and high visibility. Smoke blocker 114 blocks smoke by sealing gap 105 between bottom surface 103 of the door and the underlying floor surface. Smoke blocker 114 is capable of being folded inward along dashed line 126, wherein the folded sections connect to smoke blocker 114 by using hook and loop fastener strip 136 such as VELCRO® attached to smoke blocker 114.

Figure 8:
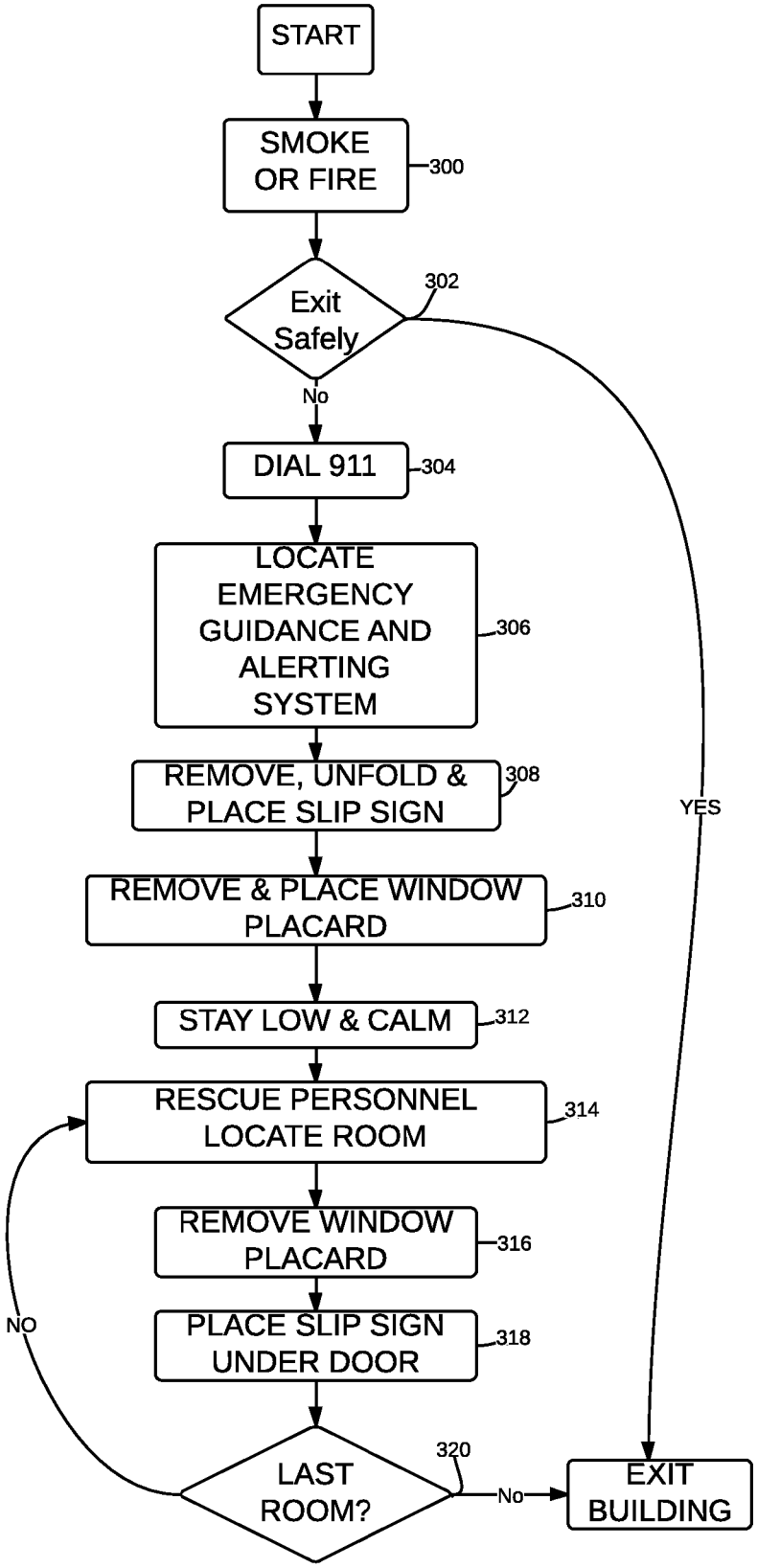
FIG. 8 illustrates in flow diagram form a sequence of acts performed in accordance with the present disclosure.

FIG. 8 illustrates in flow diagram form a sequence of acts performed in accordance with the present disclosure. At act 300, the occupant notices smoke or a fire. At decision act 302, the occupant decides whether the occupant can exit the building quickly and safely. At act 304, the occupant dials 911 giving an operator their location. At act 306, the occupant locates organizer 100, which in its preferred embodiment is attached to the back of the door leading to the hallway. At act 308, the occupant removes slip sign 106 from organizer 100, unfolds smoke blocker 114 and slides slip sign 106 under the door with smoke blocker 114 becoming flush with the door, ensuring complete coverage along the entire bottom portion of the door. At act 310, the occupant removes window placard 116 from organizer 100 and affixes window placard to the window, alerting rescue personnel personal outside that the occupant is trapped in the room. At act 312, the occupant stays low and calm until rescue personnel come to rescue the occupant from the room. At act 314, the rescue personnel has located the room and rescued the occupant from the building. At act 316, the rescue personnel removes window placard 116 from the window. At act 318, the rescue personnel takes slip sign 106 and places slip sign 106 under the door with smoke blocker 114 being in the hallway indicating that the room has been cleared. At decision act 320, if the rescue personnel has cleared the last room, then the rescue personnel safely exits the building. If the rescue personnel has not cleared the last room, then the rescue personnel goes back to act 314 and locates the next room that indicates an occupant is inside. This sequence of acts repeats until there are no more rooms to be cleared.

Although exemplary embodiments have been shown and described, it will be clear to those of ordinary skill in the art that a number of changes, modifications, or alterations to the disclosure as described may be made. All such changes, modifications, and alterations should therefore be seen as within the scope of the disclosure.

What is claims is:

1. An emergency guidance and alerting system comprising:

an organizer;

a slip sign;

a window placard;

wherein the organizer is located in a room having a door; and wherein the organizer is capable of holding the slip sign and the window placard; and wherein the slip sign is capable of being placed under a door so that the slip sign can be viewed outside of the room, alerting rescue personnel that an occupant is in the room; and wherein the window placard is capable of being attached to a window alerting rescue personnel outside of the room that the occupant is in the room; and wherein the window placard comprises of a suction cup, which fixedly attaches the window placard to the window; and wherein the slim sign further comprises a smoke blocker capable of being folded and attached to itself by the use of hook and loop fasteners.

2. The emergency guidance and alerting system of claim 1, wherein the organizer further comprises grommets capable of receiving screws to affix the organizer to a door.

3. The emergency guidance and alerting system of claim 1, wherein the organizer further comprises a notice, which is capable of alerting the occupant that the organizer contains the slip sign and window placard.

4. The emergency guidance and alerting system of claim 1, wherein the organizer further comprises a direction sheet, which instructs the occupant how to use the emergency guidance and alerting system.

5. The emergency guidance and alerting system of claim 1, wherein the smoke blocker is capable of blocking smoke by sealing a gap between a bottom surface of the door and a floor surface.

6. The emergency guidance and alerting system of claim 1, wherein the slip sign is capable of being placed under a door so that a text placed on the smoke blocker can be viewed outside of the room, alerting the rescue personnel rescue personnel that the room has no occupants.

7. The emergency guidance and alerting system of claim 1, wherein the slip sign further comprises lettering capable of alerting rescue personnel and stripes capable of alerting the rescue personnel.

8. The emergency guidance and alerting system of claim 1, wherein the window placard further comprises print capable of alerting rescue personnel and bands capable of alerting the rescue personnel.

9. A method for using an emergency guidance and alerting system, the method comprising:

locating the emergency guidance and alerting system in a room, the emergency guidance and alerting system comprises an organizer containing a slip sign with a smoke blocker fixedly attached to the slip sign and a window placard with a suction cup fixedly attached to the window placard;

removing the slip sign from the organizer;

unfolding the smoke blocker;

placing the slip sign under a door so that the slip sign can be viewed outside of the room alerting rescue personnel that an occupant is in the room and the smoke blocker being flush with the door, sealing a gap between a bottom surface of the door and an underlying floor surface;

removing a window placard from the organizer, wherein; and affixing the window placard to a window alerting rescue personnel outside the room that the occupant is in the room needed to be rescued.

* * * * *